US009870850B2

(12) United States Patent
Ishida et al.

(10) Patent No.: US 9,870,850 B2
(45) Date of Patent: Jan. 16, 2018

(54) PTC THERMISTOR MEMBER

(71) Applicant: National University Corporation Nagoya University, Nagoya-shi (JP)

(72) Inventors: Yoshihiko Ishida, Nagoya (JP); Naoyuki Kanetake, Nagoya (JP); Makoto Kobashi, Nagoya (JP)

(73) Assignee: NATIONAL UNIVERSITY CORPORATION NAGOYA UNIVERSITY, Nagoya-Shi, Aichi (JP)

( * ) Notice: Subject to any disclaimer, the term of this patent is extended or adjusted under 35 U.S.C. 154(b) by 68 days.

(21) Appl. No.: 14/889,655

(22) PCT Filed: Apr. 25, 2014

(86) PCT No.: PCT/JP2014/002354
§ 371 (c)(1),
(2) Date: Nov. 6, 2015

(87) PCT Pub. No.: WO2014/181525
PCT Pub. Date: Nov. 13, 2014

(65) Prior Publication Data

US 2016/0118166 A1 Apr. 28, 2016

(30) Foreign Application Priority Data

May 9, 2013 (JP) ..... 2013-099436
May 9, 2013 (JP) ..... 2013-099437

(51) Int. Cl.
*H01C 7/10* (2006.01)
*H01C 7/02* (2006.01)
*H01C 7/00* (2006.01)

(52) U.S. Cl.
CPC ..... *H01C 7/021* (2013.01); *H01C 7/02* (2013.01); *H01C 7/022* (2013.01); *H01C 7/008* (2013.01)

(58) Field of Classification Search
CPC ..... H01C 7/02; H01C 7/021; H01C 7/022; H01C 7/008
(Continued)

(56) References Cited

U.S. PATENT DOCUMENTS 6,224,790 B1 5/2001 Ishida
6,300,862 B1 10/2001 Ishida
(Continued)

FOREIGN PATENT DOCUMENTS

CN 1307342 A 8/2001
JP H 04-035001 A 2/1992
(Continued)

OTHER PUBLICATIONS

Extended European Search Report in European Application No. 14795499.4 dated Dec. 21, 2016.
JPO Website computer-generated English translation of JP 2004-359526 A.
(Continued)

*Primary Examiner* — Kyung Lee
(74) *Attorney, Agent, or Firm* — McGinn IP Law Group, PLLC.

(57) ABSTRACT

A PTC thermistor device has a PTC thermistor member and electrodes. The electrodes, are formed on respective surfaces of the PTC thermistor member. The PTC thermistor member contains a matrix phase, and conductive particles dispersed throughout the matrix phase. The matrix phase contains an electrically insulating first inorganic material and an electrically insulating second inorganic material. The first inorganic material undergoes phase transition in terms of crystal structure type and change in volume, at the phase transition temperature thereof. The second inorganic material is fibrous.

20 Claims, 1 Drawing Sheet

(58) Field of Classification Search
USPC ..... 338/22 R
See application file for complete search history.

(56) References Cited

U.S. PATENT DOCUMENTS

| | | | | |
|---|---|---|---|---|
| 6,472,972 | B1 | 10/2002 | Ishida | |
| 6,547,989 | B1 * | 4/2003 | Ishida | H01C 7/021 252/500 |
| 7,271,369 | B2 * | 9/2007 | Li | H01C 7/02 219/505 |
| 2006/0231807 | A1 * | 10/2006 | Tosaka | C08K 3/08 252/500 |

FOREIGN PATENT DOCUMENTS

| | | | |
|---|---|---|---|
| JP | 09-180906 | A | 7/1997 |
| JP | 10-261505 | A | 9/1998 |
| JP | 10-261506 | A | 9/1998 |
| JP | 2001-237104 | | 8/2001 |
| JP | 2003-257704 | A | 9/2003 |
| JP | 2004-359526 | | 12/2004 |
| JP | 2004-359526 | | 1/2007 |
| JP | 2007-005547 | | 1/2007 |
| JP | 62-50505 | A | 4/2010 |
| WO | WO 2010/038770 | A1 | 4/2010 |

OTHER PUBLICATIONS

International Search Report (ISR) (PCT Form PCT/ISA/210), in PCT/JP2014/002354, dated Aug. 5, 2014.
Chinese Office Action dated Apr. 1, 2017 with an English translation thereof.

* cited by examiner

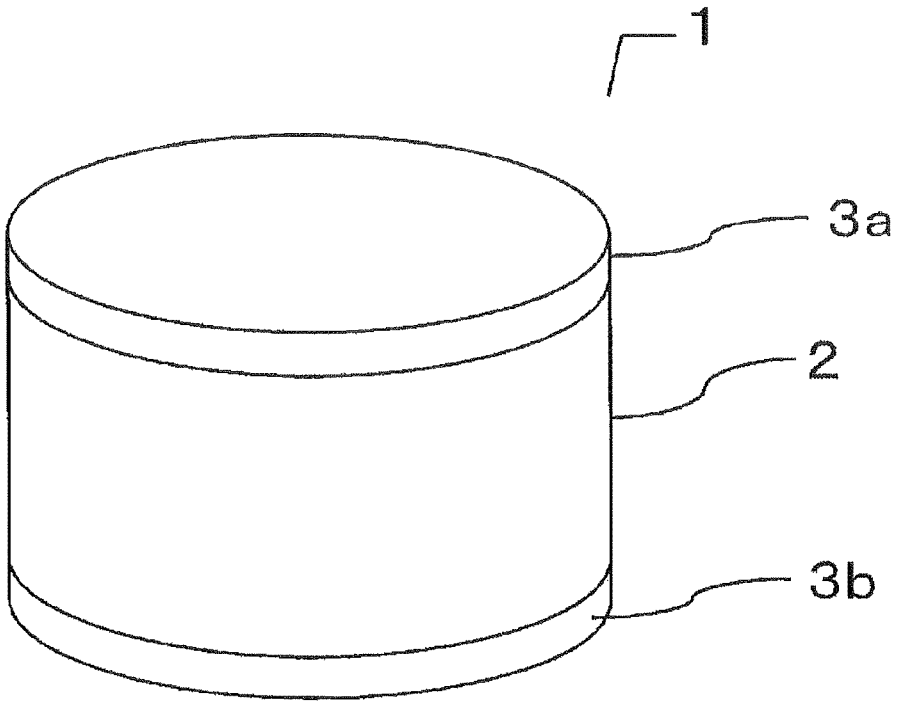
1
3a
2
3b

PTC THERMISTOR MEMBER

TECHNICAL FIELD

The present invention relates to a PTC thermistor member which is suitably employed in a PTC heater, an overload protection device, etc.

BACKGROUND ART

PTC (positive temperature coefficient of resistance) material has such a property that the electrical resistance thereof steeply increases at a certain temperature. Thus, PTC material is employed for, for example, suppressing short circuit current of a lithium ion secondary battery or serving as a current limiter that can prevent overload current of a motor. Furthermore, PTC material is also used as a heater material that can spontaneously maintain the temperature through passage of current.

As disclosed in Patent Document 1, one well-known PTC material is a barium titanate ceramic material which undergoes change in electric properties at a specific temperature. However, such a barium titanate ceramic material has high electrical resistivity at room temperature. Therefore energy loss involved in current passage is significant. Also, in order to make such a barium titanate ceramic material fit for some uses, lead must be added thereto. That causes a problem against environmental circumstances. In addition, the production cost of the barium titanate ceramic material is high. Thus, alternative PTC materials have been sought.

Under such circumstances, researchers previously found that a composite material formed of a polymer matrix and a conductive substance as an additive exhibits a PTC characteristic. The term "PTC characteristic" refers to such a specific characteristic that the electrical resistivity of the material steeply increases at a specific temperature. Patent Document 2 discloses a composite material which is a mixture of a crystalline polymer (e.g., electrically insulating polyethylene) and conductive particles (e.g., carbon particles). When the mixing ratio is adjusted to a specific value, a conduction path is formed in the polymer matrix of the composite material. That is, at a certain mixing ratio, electrical resistivity drastically decreases as the amount of conductive particles increases.

In the composite material produced so as to have such a mixing ratio, thermal expansion of the polymer matrix is considerably significant as compared with that of the conductive particles. Thus, when the composite material is heated, the crystalline polymer suddenly expands when it melts. The expanding crystalline polymer separates the conductive particles which form a conduction path in the polymer matrix. As a result, the conduction path is cut, to thereby steeply elevate electrical resistivity. Thus, a PTC characteristic is attained.

Meanwhile, a composite material containing an organic material matrix (e.g., a polymer) has poor heat resistance. The material cannot be used in a stable manner in a heater maintained at a high temperature of 150° C. or higher. In addition, since the composite material contains conductive carbon particles, the specific resistivity can be elevated merely to about 1 Ω·cm. Thus, possible use of the composite material is strictly limited.

In order to overcome the aforementioned drawback, there has been developed a composite material formed of a mixture of cristobalite or tridymite with conductive particles. Both cristobalite and tridymite are inorganic materials having high thermal expansion coefficient. Patent Documents 3 to 5 disclose inorganic composite PTC thermistor members, each of which exhibits a room-temperature resistivity about 1/10 to about 1/100 that of a composite material employing, for example, a polymer matrix. Such inorganic composite PTC thermistor members have higher heat resistance, as compared with a PTC thermistor member employing a polymer matrix.

PRIOR ART DOCUMENTS

Patent Documents

Patent Document 1: WO 2010/038770
Patent Document 2: Japanese Patent Publication No. 1987-50505
Patent Document 3: Japanese Patent Application Laid-Open (kokai) No. 1997-180906
Patent Document 4: Japanese Patent Application Laid-Open (kokai) No. 1998-261505
Patent Document 5: Japanese Patent Application Laid-Open (kokai) No. 1998-261506

SUMMARY OF THE INVENTION

Problems to be Solved by the Invention

Cristobalite has a low-temperature-mode crystal structure type and a high-temperature-mode crystal structure type. Therefore, when the temperature of cristobalite is elevated, the low-temperature-mode crystal structure type undergoes phase transition to the high-temperature-mode crystal structure type. During the crystal phase transition, the volume of cristobalite increases considerably. From another aspect, cristobalite is a fragile material. Therefore, when cristobalite is subjected to passage of current for a long time or in a repeated manner, an inorganic composite material containing cristobalite suffers from cracking. Similar to cristobalite, tridymite has the same problem.

Thus, when a PTC thermistor member employing cristobalite or tridymite is used for a long time, the electrical resistivity of the composite material at room temperature gradually increases. That is, repeated passage of current results in a drop in durability. Particularly, in the case of a composite material having a large ratio of electrical resistivity after phase transition at high temperature to electrical resistivity at room temperature (PTC effect), a drop in durability due to passage of current for a long time or in a repeated manner (i.e., durability against current passage) is significant.

The present inventors have elucidated a possible reason for a drop in durability against current passage as follows. Specifically, an inorganic composite PTC thermistor member has a structure in which conductive particles which undergo slight thermal expansion are dispersed in the matrix phase, which undergoes significant thermal expansion at the phase transition temperature. Thus, when a PTC thermistor device is operated through passage of current, propagation or de novo generation of cracking readily occurs due to repetition and long-term integration of passage of current.

Notably, the greater the mean particle size of conductive particles, the greater the PTC effect. Also, the greater the thermal expansion coefficient of the matrix phase, the greater the PTC effect. However, PTC thermistor members exhibiting great PTC effect tend to exhibit low durability against repetition and long-term integration of passage of current. In other words, the greater the size of conductive particles, or the more significant the thermal expansion of the matrix phase, the greater the stress applied to a portion of the matrix around the conductive particles. As a result, durability against repetition and long-term integration of passage of current is reduced. Generally, there is a trade-off relationship between the electrical "PTC effect" and the mechanical "durability against current passage."

As used herein, the term "PTC effect" refers to a ratio of electrical resistivity after phase transition at high temperature to electrical resistivity at room temperature. The term "durability against current passage" refers to a durability of a PTC thermistor member against passage of current. The term "durability against current passage" encompasses "cycle durability" and "long-term durability." The term "cycle durability" refers to a change in electrical resistivity after repeated passage of current. The term "long-term durability" refers to a change in electrical resistivity after application of voltage for a long period of time.

The present invention has been conceived to solve the aforementioned problems involved in conventional techniques. Thus, an object of the present invention is to provide a PTC thermistor member having a great PTC effect and durability against current passage.

Means for Solving the Problems

The PTC thermistor member of a first aspect contains a matrix phase, and conductive particles dispersed throughout the matrix phase. The matrix phase contains an electrically insulating first inorganic material and an electrically insulating second inorganic material. The first inorganic material undergoes phase transition in terms of crystal structure type and change in volume, at the phase transition temperature thereof. The second inorganic material is fibrous.

The PTC thermistor member contains an electrically insulating fibrous material which is dispersed in the matrix phase. Thus, when cracking occurs in the matrix phase, the fibrous material inhibits progress of cracking. Therefore, even when passage of current is repeatedly carried out, rise in electrical resistivity is suppressed to a certain extent. The rise is also suppressed, after long-term passage of current. In other words, the PTC thermistor member is excellent in durability against current passage. Therefore, even when a PTC thermistor member has been designed, with significant thermal expansion of the inorganic material being taken in account, excellent durability against current passage can be attained. As a result, the PTC thermistor member can be suitably employed as an overload suppression device to be installed in an electric apparatus for mobile use, a domestic electric appliance, an information apparatus, etc. Also, the PTC thermistor member can be suitably employed as a PTC heater device.

In the PTC thermistor member of the second aspect, the first inorganic material contains at least one material selected from among cristobalite-form silicon dioxide, tridymite-form silicon dioxide, cristobalite-form aluminum phosphate, tridymite-form aluminum phosphate, and carnegieite. The phase transition temperatures of these inorganic materials are about 130° C. to about 350° C. Among these materials, inorganic materials having a phase transition temperature of about 200° C. or lower can be employed in an overload protection device to be installed in a domestic electric appliance and an automobile apparatus. Other inorganic materials having a higher phase transition temperature may be employed in a PTC heater. The aforementioned inorganic materials undergo thermal expansion at about 0.3% to about 1.3% when heated beyond the phase transition temperature. Thus, a PTC thermistor member containing any of these inorganic materials exhibits great PTC effect. Therefore, the PTC thermistor member is suitably employed in an overload protection device for domestic electric appliance and automobile apparatus, or a PTC heater for use in automobiles.

In the PTC thermistor member of the third aspect, the second inorganic material contains at least one material selected from among zirconia fiber, alumina fiber, silica fiber, alumina-silica fiber, insulating tyranno fiber, and glass fiber. Through employment of one or more members of the materials as the second inorganic material, the second inorganic material is tightly sintered with the first inorganic material at the sintering temperature. As a result, durability of the matrix phase against thermal stress can be enhanced, without inhibiting the thermal expansion of the first inorganic material. That is, very high durability against passage of current can be attained.

In the PTC thermistor member of the fourth aspect, the matrix phase contains an electrically insulating third inorganic material. The third inorganic material is a glass composition having a softening point of 800° C. or lower.

In the PTC thermistor member of the fifth aspect, the glass composition contains at least one material selected from among borosilicate glass, bismuth borosilicate glass, lead borate glass, lead silicate glass, lead borosilicate glass, phosphate glass, and vanadate glass.

In the PTC thermistor member of the sixth aspect, the second inorganic material has a mean fiber diameter of 1 μm to 10 μm. The following features are important for the second inorganic material. Specifically, a large amount of the second inorganic material is dispersed in the first inorganic material. The second inorganic material is favorably sintered with the first inorganic material, to thereby provide a dense structure. Generation of large tensile stress should be prevented in the first inorganic material. When the second inorganic material has a mean fiber diameter in excess of 10 μm, the amount of the second inorganic material is small, and progress of sintering is impeded. In addition, tensile stress of a portion of the first inorganic material around the second inorganic material is large.

In the PTC thermistor member of the seventh aspect, the volume fraction of the second inorganic material with respect to the matrix phase is 1% to 30%. When the volume fraction of the second inorganic material with respect to the matrix phase is lower than 1%, the effect of inhibiting generation and progress of cracking cannot be fully attained, whereas when the volume fraction of the second inorganic material with respect to the matrix phase is in excess of 30%, thermal expansion of the matrix phase is suppressed; i.e., the PTC effect cannot be fully attained.

In the PTC thermistor member of the eighth aspect, the first inorganic material is granular. The first inorganic material has a mean particle size of 1 μm to 50 μm. When the mean particle size of the first inorganic material is 50 μm or less, a dense matrix phase can be formed even through sintering at low temperature. In this case, the strength of the matrix phase and durability against current passage are excellent.

In the PTC thermistor member of the ninth aspect, electrical resistivity at a temperature equal to or higher than the phase transition temperature is at least 1,000 times greater than that at room temperature.

Effects of the Invention

The present invention provides a PTC thermistor member having a great PTC effect and durability against current passage.

BRIEF DESCRIPTION OF THE DRAWINGS

FIG. 1 A schematic view of an overload protection device (current-limiting device) or a PTC heater device, employing a PTC thermistor member of embodiments of the invention.

MODES OF CARRYING OUT THE INVENTION

Embodiments will next be described, with reference to the drawing. The following embodiments direct to a PTC thermistor member and a PTC thermistor device. In the following embodiments, the term "PTC effect" refers to a ratio of electrical resistivity after phase transition at high temperature to electrical resistivity at room temperature. The term "durability against current passage" refers to a durability of a PTC thermistor member against passage of current. The term "durability against current passage" encompasses "cycle durability" and "long-term durability." The term "cycle durability" refers to a change in electrical resistivity after repeated passage of current. The term "long-term durability" refers to a change in electrical resistivity after application of voltage for a long period of time.

First Embodiment

1. PTC Thermistor Device

FIG. 1 is schematic view of a PTC thermistor device employing a PTC thermistor member of the first embodiment. A PTC thermistor device 1 is an inorganic composite PTC thermistor device containing a plurality of inorganic materials. As shown in FIG. 1, the PTC thermistor device 1 has a PTC thermistor member 2 and electrodes 3*a*, 3*b*. The electrodes 3*a*, 3*b* are formed on respective surfaces of the PTC thermistor member 2.

2. PTC Thermistor Member

The PTC thermistor member 2 contains a matrix phase, and conductive particles dispersed throughout the matrix phase. The matrix phase contains an electrically insulating first inorganic material and an electrically insulating second inorganic material. The first inorganic material undergoes phase transition in terms of crystal structure type and change in volume, at the phase transition temperature thereof. The second inorganic material is fibrous.

The electrical and mechanical characteristics of the PTC thermistor member 2 depend on the conditions in relation to raw materials and production steps. Specifically, PTC thermistor members 2 of different types may be produced through modifying the material and mean particle size of conductive particles, the material and mean particle size of the first inorganic material, and the material and mean fiber diameter of the second inorganic material.

2-1. First Inorganic Material

The first inorganic material is a particle-form, electrically insulating inorganic material. The first inorganic material undergoes phase transition in terms of crystal structure type and change in volume, at the phase transition temperature thereof. Examples of the first inorganic material include at least one material selected from among cristobalite-form silicon dioxide, tridymite-form silicon dioxide, cristobalite-form aluminum phosphate, tridymite-form aluminum phosphate, and carnegieite ($NaAlSiO_4$).

Among them, cristobalite-form silicon dioxide, tridymite-form silicon dioxide, cristobalite-form aluminum phosphate, and tridymite-form aluminum phosphate have a phase transition temperature of 120° C. to 250° C., at which steep thermal expansion occurs. Therefore, these materials are suitable for the matrix phase of the PTC thermistor member 2.

Upon phase transition of the first inorganic material at the phase transition temperature, the thermal expansion coefficient is about 0.3% to about 1.3%. As shown in Table 1, cristobalite-form silicon dioxide has a thermal expansion coefficient of 1.3%, tridymite-form silicon dioxide 0.8%, cristobalite-form aluminum phosphate 0.6%, tridymite-form aluminum phosphate 0.5%, and carnegieite 0.3%. The volume of the high-temperature crystal-type first inorganic material is larger than that of the low-temperature crystal type.

TABLE 1

| First inorganic material | Thermal expansion coefficient |
|---|---|
| Cristobalite-form silicon dioxide | 1.3% |
| Tridymite-form silicon dioxide | 0.8% |
| Cristobalite-form aluminum phosphate | 0.6% |
| Tridymite-form aluminum phosphate | 0.5% |
| Carnegieite | 0.3% |

The mean particle size of the first inorganic material is preferably 1 μm to 50 μm. The mean particle size is measured according to JIS Z 8827-1: 2008, particle-size-analysis-graphic-analysis method. As a sample, a mirror-polished sample of a target inorganic material is used, and particles to be analyzed are chosen from an electron microscopic image of the mirror-polished surface. The "circle-equivalent diameter" of the chosen particles is determined. The number of samples to be analyzed is determined as the minimum sampling number as defined by Table 3 of JIS Z 8827-1: 2008. When the first inorganic material has a mean particle size of 50 μm or less, the entire matrix phase can be provided with high sintering density, even though the sintering temperature is low.

2-2. Second Inorganic Material

The second inorganic material is a fibrous, electrically insulating inorganic material. The second inorganic material contains at least one material selected from among zirconia fiber, alumina fiber, silica fiber, alumina-silica fiber, insulating tyranno fiber, and glass fiber.

The mean fiber diameter of the second inorganic material is preferably 1 μm to 10 μm. The mean fiber diameter is measured according to JIS Z 8827-1: 2008, particle-size-analysis-graphic-analysis method. As a sample, a fracture surface sample of a target inorganic material is used, and fracture surface areas of fiber filaments are chosen from an electron microscopic image of the fracture surfaces. The "circle-equivalent diameter" of the chosen fracture surface areas is determined. The number of samples to be analyzed is determined as the minimum sampling number as defined by Table 3 of JIS Z 8827-1: 2008.

The volume fraction of the second inorganic material with respect to the matrix phase is preferably 1% to 30%. When the volume fraction of the second inorganic material with respect to the matrix phase is lower than 1%, the effect of inhibiting generation and progress of cracking cannot be fully attained. When the volume fraction of the second inorganic material with respect to the matrix phase is in excess of 30%, thermal expansion of the matrix phase is suppressed; i.e., the PTC effect cannot be fully attained.

2-3. Conductive Particles

The conductive particles provide the matrix phase with electrical conductivity. The conductive particles are also referred to as a conductive filler. The material of the conductive particles which may be used in the invention includes metals having high melting point such as iron, nickel, titanium, molybdenum, tungsten, niobium, and tantalum. Alternatively, alloys having high melting point such as nickel alloy and stainless steel alloy, and an intermetallic compound such as $Ni_3Al$ may also be used as the conductive particles. Furthermore, metal silicides, metal borides, metal carbides, and metal nitrides may also be used as the conductive particles.

When a silicon-containing material is used as a first inorganic material, conductive particles of a metal silicide or high-conductivity SiC material are preferably used. Because bonding between the silicon-containing first inorganic material and the silicon-containing conductive particles is strong. In other words, a PTC thermistor member 2 employing this combination exhibits high durability.

The conductive particles have a mean particle size of 10 μm to 60 μm. When the mean particle size of the conductive particles is 10 μm to 50 μm, the PTC thermistor member 2 employing the particles exhibits remarkably high PTC effect and high durability against current passage. The mean particle size of the conductive particles may be determined through the same method as employed in determination of the mean particle size of the first inorganic material. The volume fraction of the conductive particles with respect to the matrix phase is preferably 15% to 40%. The volume fraction of the conductive particles with respect to the matrix phase is more preferably 15% to 30%. Notably, through modification of the mean particle size of the conductive particles or the volume fraction of an element with respect to the matrix phase, the aspect of conduction path in the PTC thermistor member 2 varies.

3. Characteristics of PTC Thermistor Member

The PTC thermistor member 2 of the first embodiment contains the first inorganic material which undergoes phase transition in terms of crystal structure type, at the phase transition temperature thereof, and the second inorganic material which is fibrous. The first inorganic material separates the conductive particles via thermal expansion. Through thermal expansion, most of the conduction paths formed by the conductive particles are cut, whereby high PTC effect can be attained. Meanwhile, the fibrous second inorganic material suppresses micro-cracking in the matrix phase. Even though micro-cracking occurs, progress of cracking is inhibited. Therefore, when the PTC thermistor member 2 is subjected to repeated passage of current, the electrical resistivity does not vary greatly.

In addition, even in the case where large conductive particles or an inorganic material having a large thermal expansion coefficient is used, a PTC thermistor member 2 exhibiting high PTC effect can be produced, without lowering durability against current passage. The electrical resistivity of the PTC thermistor member 2 at a temperature not lower than phase transition temperature is 1,000 times greater than that at room temperature. Some examples of the PTC thermistor member 2 exhibit a PTC effect which is about 10,000 times to 1,000,000 times higher, as well as durability against current passage.

The first inorganic material and the second inorganic material employed in the first embodiment are suitable for forming a matrix material of the PTC thermistor member. All of the first inorganic material and the second inorganic material have a melting point or a decomposition temperature as high as ≥1,000° C. In addition, the first inorganic material and the second inorganic material have excellent heat resistance, as compared with polymers (i.e., organic materials), and are stable against matrix melting or the like even under high temperature conditions.

The electrical resistivity of the PTC thermistor member 2 may be tuned within the range of 0.005 Ωcm to 1,000 Ωcm through modifying conditions of the conductive particles. Among such PTC thermistor members 2, those having small electrical resistivity are suitable for overload protection devices, while those having large electrical resistivity are suitable for PTC heaters.

4. Method for Preparation of Raw Materials 4-1. Method for Preparing First Inorganic Material Commercially available first inorganic materials, as industrial materials, may be used without any further treatment. For example, cristobalite-form silicon dioxide is used as a coating material of coated paper or the like. Cristobalite-form aluminum phosphate and tridymite-form aluminum phosphate are industrially mass-produced as a steel sheet chemical treatment agent. Among these raw materials, those having a large particle size may be pulverized through a method such as wet pulverization by means of a pot mill.

Cristobalite-form silicon dioxide and tridymite-form silicon dioxide may be produced from quartz ($SiO_2$) powder serving as a starting material by calcining the powder at a high temperature where the crystal system is stable. Alternatively, these silicon dioxides may be produced at lower calcining temperature in the presence of an alkali metal or an alkaline earth metal, which stabilizes the crystal system. Yet alternatively, these silicon oxides may be produced from quartz as a raw material with an alkali metal or an alkaline earth metal, which serves as a crystal system stabilizer. In one specific procedure, quartz is transformed into cristobalite-form silicon dioxide and tridymite-form silicon dioxide in, for example, a firing step after molding.

Carnegieite ($NaAlSiO_4$) powder may be produced by mixing, for example, sodium carbonate ($Na_2CO_3$) powder, aluminum oxide ($Al_2O_3$) powder, and quartz ($SiO_2$) powder at specific mole proportions, decarbonating the thus-obtained raw material mixture at 850° C., and calcining the mixture at 900° C. to 1,350° C.

Among the thus-produced first inorganic materials, those having a suitable mean particle size may be used without any further treatment. A first inorganic material (powder form) having a large mean particle size is pulverized by means of a wet pot mill. Through pulverization, an inorganic material powder having a mean particle size of, for example, 1 μm to 50 μm can be produced.

4-2. Method for Preparing Second Inorganic Material

The second inorganic material is widely utilized as an industrial material. Thus, there may be employed, without any further treatment, a second inorganic material product having such a product grade that the fiber diameter distribution profile is about 10 μm or less as a mean fiber diameter. Before use thereof, such a product may be cut into fragments having an appropriate length.

4-3. Method for Preparing Conductive Particles

Commercially available conductive particles as an industrial material are classified by means of a sieve to a specific particle size. Newly synthesized conductive particles are pulverized and then classified, before use.

5. PTC Thermistor Member Production Method

Next will be described the method of producing the PTC thermistor member 2 of the first embodiment.

5-1. Raw Material Preparation Steps

The first inorganic material, the second inorganic material, and the conductive particles are prepared through the aforementioned methods. The thus-obtained raw materials have suitable properties, including mean particle size.

5-2. Mixing Step

Then, the first inorganic material, the second inorganic material, and the conductive particles are mixed together. Before mixing, each of the first inorganic material, the second inorganic material, and the conductive particles is weighed so as to attain specific proportions. The raw materials are mixed with a binder under dry or wet conditions, to thereby obtain a mixture. Examples of the binder include polyvinyl alcohol (PVA), polyvinyl butyral (PVB), and cellulose material.

Alternatively, clay powder may be added as a molding aid with mixing under dry or wet conditions. Glass powder or a material that can form a liquid phase through reaction with the first inorganic material may be added as a sintering aid. Notably, clay powder may also serve as a sintering aid.

5-3. Molding Step

The thus-obtained mixture is molded. Specifically, the aforementioned mixture is press-molded under dry conditions, to thereby form a compact. Alternatively, the mixture is mixed with a binder for molding, and the resultant mixture is extruded under wet conditions, to thereby yield a compact.

5-4. Sintering Step

The thus-obtained compact is sintered. Specifically, the compact is sintered under a flow of a non-oxidizing gas such as hydrogen, nitrogen, or argon while oxidation of conductive particles is prevented. The sintering treatment temperature is, for example, 1,000° C. to 1,500° C. Needless to say, this temperature range is merely an example. The treatment temperature varies depending on the material of the first inorganic material and that of the second inorganic material. Sintering is performed in an atmospheric condition. Through this sintering step, a dense sintered product can be yielded.

5-5. Relationship Between Production Conditions and Characteristics of PTC Thermistor Member In the first embodiment, the relative density of the sintered PTC material is preferably elevated to 95% or higher. For this purpose, the mean particle size of the first inorganic material and that of the second inorganic material are preferably reduced. The material and particle size of the sintering aid are chosen depending on the first inorganic material and the second inorganic material, and sintering conditions are determined. Through such control, the relative density can be elevated to 95% or higher. When the relative density is 95% or lower, a relatively large number of crystal defects and cracks are often present in the sintered product. In some cases, breakage progresses from such defects and cracks due to repeated passage of current, resulting in impairment of durability against current passage.

In order to produce the PTC thermistor member 2 having a large PTC effect, the following is important. Specifically, a matrix phase having large thermal expansion coefficient is chosen, and conductive particles having a large mean particle size are selected. The first inorganic materials shown in Table 1 exhibit a large percent change in thermal expansion before and after passage of the phase transition point, and the percent change is extraordinary large for inorganic materials. Therefore, it is preferred that thermal expansion of the first inorganic material is not inhibited.

For reducing the thermal expansion coefficient of the entire matrix phase, the following techniques may be employed. For example, there may be employed addition of ions of an alkali metal or alkaline earth metal such as Li, Na, K, Mg, or Ca; reducing the particle size of the first inorganic material; incorporation into the matrix phase of a certain volume fraction of the second inorganic material having a small thermal expansion coefficient; or transforming the crystal structure type of the first inorganic material into another one through elevating the firing temperature.

In contrast, for elevating the thermal expansion coefficient of the entire matrix phase, the following techniques may be employed. For example, there may be employed reducing the amounts of ions of an alkali metal or alkaline earth metal; increasing the particle size of the first inorganic material; reducing the volume fraction of the fibrous second inorganic material in the matrix phase; or firing at low temperature. Firing in a stream of hydrogen (at low oxygen partial pressure) is also effective for enhancing the thermal expansion of the first inorganic material. Through increasing the particle size of the conductive particles, the network formed by the conductive particles is highly likely to break during expansion of the matrix phase. Therefore, use of conductive particles having large mean particle size directly results in enhancement in "PTC effect."

6. Modification 6-1. Molding Step

In the aforementioned molding step, there may be applied a method in which a sheet-form molded product is subjected to application of compressive torsion during extrusion under wet conditions. Through this method, the fibrous second inorganic material can be uniformly dispersed in the matrix. The thus-obtained molded product may further be subjected to isotropic pressing, to thereby yield a molded product having higher density.

6-2. Sintering Step

In the sintering step, the compact may be subjected to hot pressing in the same non-oxidizing gas flow, while the compact continuously receives a specific load. Through this process, a high-density compact can be yielded. When the compact is dried and subjected to isotropic pressing, a high-density sintered body is formed. In addition, through employment of compressive torsion in which compression and torsion are simultaneously applied during firing in the hot-press method, the fibrous second inorganic material can be further uniformly dispersed. An additional organic binder may be added to the compact after drying, and there may be added a debinding step which the organic binder is decomposed at about 300° C.

6-3. Method for Preparation of Raw Materials

In the first embodiment, the thus-prepared first inorganic material and second inorganic material were mixed together, and the obtained mixture was sintered at high temperature. In the sintering step, the first inorganic material and the second inorganic material may be finally formed in the matrix phase.

7. Summary of the First Embodiment

The PTC thermistor device 1 of the first embodiment has a PTC thermistor member 2, and electrodes 3*a*, 3*b*. The PTC thermistor member 2 contains a granular first inorganic material, a fibrous second inorganic material, and conductive particles. The fibrous second inorganic material can suppress progress of cracking in the matrix phase. Thus, the PTC thermistor member 2 has high PTC effect as well as high durability against current passage.

Second Embodiment

The second embodiment will next be described. The PTC thermistor member 2 of the second embodiment contains, in addition to the raw materials employed in the first embodiment, a third inorganic material mentioned below. Thus, points differing from the first embodiment will mainly be described.

1. PTC Thermistor Member

The PTC thermistor member 2 of the second embodiment includes a matrix phase, and conductive particles dispersed throughout the matrix phase. The matrix phase contains an electrically insulating first inorganic material, an electrically insulating second inorganic material, and an electrically insulating third inorganic material. The first inorganic material undergoes phase transition in terms of crystal structure type and change in volume, at the phase transition temperature thereof. The second inorganic material is fibrous. The third inorganic material is a glass composition having a softening point of 800° C. or lower.

2. Third Inorganic Material (Low-Melting Glass)

The third inorganic material is an electrically insulating low-melting-temperature glass. In the second embodiment, the low-melting-temperature glass is a glass composition having a softening point of 800° C. or lower. The softening point is determined in accordance with the "needle-insert method" as defined by "JIS K 7196." Specifically, a specified test piece is cut out from the target conductive inorganic composite material, and the test piece is subjected to analysis by means of an analyzer which enables measurement of the sample at high temperature in inert gas. The glass composition contains, for example, at least one material selected from among borosilicate glass, bismuth borosilicate glass, lead borate glass, lead silicate glass, lead borosilicate glass, phosphate glass, and vanadate glass.

The low-melting-point glass is a particulate material. The low-melting-point glass undergoes change in volume via glass transition or melting. Thus, when the PTC thermistor member 2 of the second embodiment is heated, the glass undergoes expansion in volume thereof around the crystal structure type phase transition temperature of the first inorganic material, and also undergoes volume expansion near the glass transition temperature of the low-melting-point glass or at a temperature near the melting temperature thereof. Thus, the PTC thermistor member 2 undergoes volume expansion within a specific temperature range in accordance with conditions including employment of raw materials, and also undergoes change in electrical resistivity.

The PTC thermistor member 2 of the second embodiment may be produced through firing at low temperature. Therefore, a material having not considerably high melting point may be used as conductive particles. Also, upon firing at low-temperature, high-softening-point S glass fiber cannot be melted during firing, since the softening point of the high-softening-point S glass fiber is about 970° C. Therefore, such a high-softening-point S glass fiber may be used as the second inorganic material. As a result, the cycle durability of the PTC thermistor member 2 can be enhanced.

In addition to high-melting conductive material, other metallic materials may be used as the material of electrodes 3*a*, 3*b*. Examples of such metallic materials include pure copper, high-copper alloys (beryllium-copper, titanium-copper, zirconium copper, tin-containing copper, and iron-containing copper), bronze, nickel silver, phosphor bronze, and copper nickel alloys. The PTC thermistor device 1 of the second embodiment works correctly, even under passage of comparatively large current.

EXAMPLES (A) Experiment 1

Next will be described Experiment 1. Experiment 1 corresponds to the first embodiment. Thus, in Experiment 1, the third inorganic material was not used.

1. Raw Material of PTC Thermistor Member (Test Pieces)

As first inorganic materials, cristobalite-form silicon dioxide, tridymite-form silicon dioxide, and carnegieite were used. As second inorganic materials, alumina fiber, zirconia fiber, silica fiber, alumina-silica fiber, and tyranno fiber were used. As conductive particles, a metal (Ni, Mo), a metal silicide ($MoSi_2$, $NbSi_2$, $TiSi_2$), a metal boride ($TiB_2$), a metal carbide (TiC), and a metal nitride (TiN) were used.

2. Method of Fabricating a PTC Thermistor Member (Test Pieces)

In this experiment, a PTC thermistor member sample was fabricated from the aforementioned raw material under specific conditions. The typical fabrication method was as follows. The same preparation methods as employed in the first embodiment were employed for preparing the first inorganic material and the second inorganic material. As the conductive particles, commercially available industrial materials were used. The conductive particles were selected through classifying by means of a sieve.

Firstly, the first inorganic material, the fibrous second inorganic material, and conductive particles were mixed at specific proportions under dry conditions. To the mixture, methylcellulose powder (2.0 vol. %) serving as a binder for molding and then clay powder (1.0 vol. %) serving as a molding aid and a sintering aid were added, with mixing under dry conditions.

Pure water was added to the mixture, and the resultant mixture was extruded under wet conditions, to thereby produce a compact. The compact was dried and debindered at 320° C. Subsequently, the compact was fired in an atmosphere consisting of hydrogen (99%) and nitrogen (1%). The temperature of the atmosphere gas was 1,200° C. In the case where an alumina-silica fiber was used as a second inorganic material, the temperature of the atmosphere gas was 1,100° C. The firing time was 3 hours.

Test pieces for a current passage test were prepared. Specifically, a bake-form type electrode material mainly containing tungsten was applied onto each of the above-sintered compacts, and the compact was fired to form a low-resistance electrode layer. The thus-formed test piece had dimensions of 5 mm×5 mm×2 mm. The test piece had a thickness of 2 mm.

3. Evaluation Method

In this experiment, "PTC effect," "cycle durability," and "long-term durability" were evaluated. The "PTC effect" was calculated from the electrical resistivity of a test piece at room temperature and the electrical resistivity of the test piece at a temperature higher than the phase transition temperature. The "cycle durability" was evaluated by measuring a percent change in electrical resistivity after 500-cycle passage of current at a predetermined voltage. Two voltages were predetermined; 15 V for general vehicles and 24 V for trucks and the like. The duration of current passage per cycle was 30 seconds. The "long-term durability" was evaluated through continuous passage of current for 72 hours, and measuring the electrical resistivity of the test piece before and after current passage.

A higher PTC effect is preferred. Regarding cycle durability against repeated current passage, a smaller percent change in electrical resistivity is preferred.

4. Results of Experiment

Next, the thus-prepared PTC thermistor member samples were assessed, and the results will be described.

4-1. Preferred PTC Thermistor Members

Table 2 shows Examples 1 to 42 and Comparative Example 1. In Examples 1 to 42, cycle durability at 15 V was 20% or lower. In Examples 1 to 39, cycle durability at 15 V was 10% or lower. Thus, the PTC thermistor members of Examples 1 to 39 are suitable for general vehicles.

TABLE 2

| | Conditions (raw materials) | | | | | | | | Results (performance) | | |
|---|---|---|---|---|---|---|---|---|---|---|---|
| | Cond. particles | | 1st inorg. material | | Fibrous 2nd inorg. material | | | | | Cycle durability % Resistivity change (%) Test Voltage | |
| | Material | Particle size (μm) | Material | Particle size (μm) | Material | Fiber diam. (μm) | Fiber length (μm) | Vol. fraction (%) | PTC effect (x) | 15 V | 24 V |
| Ex. 1 | $MoSi_2$ | 35 μm | Cristobalite $SiO_2$ | 5 μm | Alumina fiber | 6 μm | 100 μm | 5 | 55000 | 1% | 4% |
| Ex. 2 | $MoSi_2$ | 45 μm | Cristobalite $SiO_2$ | 5 μm | Alumina fiber | 6 μm | 100 μm | 5 | 221000 | 2% | 5% |
| Ex. 3 | $MoSi_2$ | 35 μm | Cristobalite $SiO_2$ | 5 μm | Zirconia fiber | 6 μm | 100 μm | 5 | 56000 | 2% | 5% |
| Ex. 4 | $MoSi_2$ | 35 μm | Cristobalite $SiO_2$ | 5 μm | Silica fiber | 6 μm | 100 μm | 5 | 75000 | 3% | 4% |
| Ex. 5 | $NbSi_2$ | 35 μm | Cristobalite $SiO_2$ | 5 μm | Alumina fiber | 6 μm | 100 μm | 5 | 52000 | 1% | 3% |
| Ex. 6 | $MoSi_2$ | 35 μm | Cristobalite $SiO_2$ | 5 μm | Alumina fiber | 6 μm | 200 μm | 5 | 41000 | 1% | 3% |
| Ex. 7 | $MoSi_2$ | 45 μm | Cristobalite $SiO_2$ | 5 μm | Alumina fiber | 6 μm | 200 μm | 5 | 154000 | 1% | 4% |
| Ex. 8 | $MoSi_2$ | 35 μm | Cristobalite $SiO_2$ | 5 μm | Alumina fiber | 6 μm | 1000 μm | 5 | 85000 | 1% | 3% |
| Ex. 9 | $MoSi_2$ | 45 μm | Cristobalite $SiO_2$ | 5 μm | Alumina fiber | 6 μm | 1000 μm | 5 | 132000 | 2% | 4% |
| Ex. 10 | $MoSi_2$ | 15 μm | Cristobalite $SiO_2$ | 5 μm | Alumina fiber | 6 μm | 100 μm | 5 | 1400 | 0% | 2% |
| Ex. 11 | $MoSi_2$ | 35 μm | Cristobalite $SiO_2$ | 5 μm | Alumina fiber | 9 μm | 100 μm | 29 | 3200 | 5% | 7% |
| Ex. 12 | $MoSi_2$ | 45 μm | Cristobalite $SiO_2$ | 5 μm | Alumina fiber | 9 μm | 100 μm | 29 | 6500 | 6% | 9% |
| Ex. 13 | $MoSi_2$ | 35 μm | Carnegieite ($NaAlSiO_4$) | 3 μm | Alumina fiber | 6 μm | 100 μm | 5 | 7000 | 1% | 5% |
| Ex. 14 | $MoSi_2$ | 35 μm | Carnegieite ($NaAlSiO_4$) | 5 μm | Alumina fiber | 6 μm | 100 μm | 5 | 9000 | 2% | 7% |
| Ex. 15 | $MoSi_2$ | 35 μm | Tridymite $SiO_2$ | 3 μm | Alumina fiber | 6 μm | 100 μm | 5 | 15000 | 3% | 6% |
| Ex. 16 | $MoSi_2$ | 35 μm | Tridymite $SiO_2$ | 5 μm | Alumina fiber | 6 μm | 100 μm | 5 | 25000 | 4% | 8% |
| Ex. 17 | $MoSi_2$ | 35 μm | Cristobalite $SiO_2$ | 5 μm | Alumina-silica fiber | 6 μm | 100 μm | 5 | 69000 | 2% | 6% |
| Ex. 18 | $TiSi_2$ | 35 μm | Cristobalite $SiO_2$ | 5 μm | Alumina fiber | 6 μm | 100 μm | 5 | 61000 | 3% | 7% |
| Ex. 19 | $TiB_2$ | 35 μm | Cristobalite $SiO_2$ | 5 μm | Alumina fiber | 6 μm | 100 μm | 5 | 31000 | 7% | 10% |
| Ex. 20 | $MoSi_2$ | 35 μm | Cristobalite $SiO_2$ | 10 μm | Alumina fiber | 6 μm | 100 μm | 5 | 62000 | 5% | 7% |
| Ex. 21 | $MoSi_2$ | 45 μm | Cristobalite $SiO_2$ | 10 μm | Alumina fiber | 6 μm | 100 μm | 5 | 334000 | 7% | 9% |
| Ex. 22 | $MoSi_2$ | 35 μm | Cristobalite $SiO_2$ | 5 μm | Alumina fiber | 6 μm | 80 μm | 5 | 76000 | 4% | 10% |
| Ex. 23 | $MoSi_2$ | 35 μm | Cristobalite $SiO_2$ | 5 μm | Tyrano fiber | 6 μm | 50 μm | 5 | 145000 | 6% | 10% |
| Ex. 24 | $MoSi_2$ | 35 μm | Cristobalite $SiO_2$ | 5 μm | Alumina fiber | 9 μm | 100 μm | 5 | 84000 | 6% | 8% |
| Ex. 25 | $MoSi_2$ | 45 μm | Cristobalite $SiO_2$ | 5 μm | Alumina fiber | 9 μm | 100 μm | 5 | 325000 | 7% | 12% |
| Ex. 26 | TiC | 35 μm | Cristobalite $SiO_2$ | 5 μm | Alumina fiber | 6 μm | 100 μm | 5 | 65000 | 6% | 11% |
| Ex. 27 | TiN | 35 μm | Cristobalite $SiO_2$ | 5 μm | Alumina fiber | 6 μm | 100 μm | 5 | 42000 | 8% | 15% |
| Ex. 28 | Ni | 35 μm | Cristobalite $SiO_2$ | 5 μm | Alumina fiber | 6 μm | 100 μm | 5 | 39000 | 6% | 18% |
| Ex. 29 | Mo | 35 μm | Cristobalite $SiO_2$ | 5 μm | Alumina fiber | 6 μm | 100 μm | 5 | 85000 | 8% | 12% |
| Ex. 30 | $MoSi_2$ | 45 μm | Cristobalite $SiO_2$ | 5 μm | Alumina fiber | 6 μm | 80 μm | 5 | 232000 | 6% | 15% |
| Ex. 31 | $MoSi_2$ | 35 μm | Tridymite $SiO_2$ | 5 μm | Alumina fiber | 6 μm | 100 μm | 0.9 | 36000 | 10% | 15% |
| Ex. 32 | $MoSi_2$ | 35 μm | Cristobalite $SiO_2$ | 5 μm | Alumina fiber | 6 μm | 100 μm | 31 | 900 | 4% | 7% |
| Ex. 33 | $MoSi_2$ | 14 μm | Cristobalite $SiO_2$ | 6 μm | Alumina fiber | 6 μm | 100 μm | 5 | 940 | 1% | 8% |

TABLE 2-continued

| | Conditions (raw materials) | | | | | | | | Results (performance) | | |
|---|---|---|---|---|---|---|---|---|---|---|---|
| | Cond. particles | | 1st inorg. material | | Fibrous 2nd inorg. material | | | | | Cycle durability % Resistivity change (%) Test Voltage | |
| | Material | Particle size (μm) | Material | Particle size (μm) | Material | Fiber diam. (μm) | Fiber length (μm) | Vol. fraction (%) | PTC effect (x) | 15 V | 24 V |
| Ex. 34 | $MoSi_2$ | 35 μm | Cristobalite $SiO_2$ | 45 μm | Alumina fiber | 6 μm | 100 μm | 5 | 76000 | 8% | 21% |
| Ex. 35 | $MoSi_2$ | 35 μm | Cristobalite $SiO_2$ | 5 μm | Alumina fiber | 11 μm | 100 μm | 5 | 82000 | 10% | 25% |
| Ex. 36 | $MoSi_2$ | 35 μm | Cristobalite $SiO_2$ | 5 μm | Alumina fiber | 6 μm | 50 μm | 5 | 86000 | 7% | 26% |
| Ex. 37 | $MoSi_2$ | 45 μm | Cristobalite $SiO_2$ | 6 μm | Alumina fiber | 6 μm | 50 μm | 5 | 332000 | 9% | 42% |
| Ex. 38 | $MoSi_2$ | 45 μm | Cristobalite $SiO_2$ | 45 μm | Alumina fiber | 6 μm | 100 μm | 5 | 352000 | 10% | 35% |
| Ex. 39 | $MoSi_2$ | 35 μm | Cristobalite $SiO_2$ | 5 μm | Alumina fiber | 6 μm | 100 μm | 0.9 | 76000 | 10% | 55% |
| Ex. 40 | $MoSi_2$ | 35 μm | Tridymite $SiO_2$ | 5 μm | Alumina fiber | 11 μm | 100 μm | 5 | 22000 | 11% | 27% |
| Ex. 41 | $MoSi_2$ | 35 μm | Cristobalite $SiO_2$ | 55 μm | Alumina fiber | 6 μm | 100 μm | 5 | 108000 | 12% | 46% |
| Ex. 42 | $MoSi_2$ | 45 μm | Cristobalite $SiO_2$ | 55 μm | Alumina fiber | 6 μm | 100 μm | 5 | 692000 | 19% | 72% |
| Comp. Ex. 1 | $MoSi_2$ | 35 μm | Cristobalite $SiO_2$ | 5 μm | | None | | | 177000 | 25% | 120% |

Table 3 is a list of PTC thermistor members having suitable cycle durability, which were extracted from Table 2. In Examples 1 to 24, the cycle durability at 24 V was 10% or lower, and the PTC effect was 1,000 times or higher. Thus, the PTC thermistor members of Examples 1 to 24 are suitable for general vehicles as well as for trucks.

The PTC thermistor member of Comparative Example 1, containing no fibrous second inorganic material, exhibited a sufficient PTC effect but a cycle durability at 15 V of 25%. That is, the percent change in electrical resistivity was significant. Thus, such durability is insufficient for use in general vehicles and trucks.

4-2. Material of Second Inorganic Material

As shown in Table 3, when alumina fiber (see Examples 1 and 2), zirconia fiber (see Example 3), or silica fiber (see Example 4) was employed as the second inorganic material, the PTC effect was elevated to 50,000 times or higher, and the percent change in electrical resistivity was suppressed to 5% or lower at a test voltage of 15 V and 24 V. When alumina-silica fiber (see Example 17) was employed as the second inorganic material, the PTC effect was elevated to 50,000 times or higher, and the percent change in electrical resistivity was suppressed to 6% at a test voltage of 15 V and 24 V. When tyranno fiber (see Example 23) was employed as the second inorganic material, the percent change in electrical resistivity was suppressed to 6% at a test voltage of 15 V, and 10% at a test voltage of 24 V.

TABLE 3

| | Conditions (raw materials) | | | | | | | | Results (performance) | | |
|---|---|---|---|---|---|---|---|---|---|---|---|
| | Cond. particles | | 1st inorg. material | | Fibrous 2nd inorg. material | | | | | Cycle durability % Resistivity change (%) Test Voltage | |
| | Material | Particle size (μm) | Material | Particle size (μm) | Material | Fiber diam. (μm) | Fiber length (μm) | Vol. fraction (%) | PTC effect (x) | 15 V | 24 V |
| Ex. 1 | $MoSi_2$ | 35 μm | Cristobalite $SiO_2$ | 5 μm | Alumina fiber | 6 μm | 100 μm | 5 | 55000 | 1% | 4% |
| Ex. 2 | $MoSi_2$ | 45 μm | Cristobalite $SiO_2$ | 5 μm | Alumina fiber | 6 μm | 100 μm | 5 | 221000 | 2% | 5% |
| Ex. 3 | $MoSi_2$ | 35 μm | Cristobalite $SiO_2$ | 5 μm | Zirconia fiber | 6 μm | 100 μm | 5 | 56000 | 2% | 5% |
| Ex. 4 | $MoSi_2$ | 35 μm | Cristobalite $SiO_2$ | 5 μm | Silica fiber | 6 μm | 100 μm | 5 | 75000 | 3% | 4% |
| Ex. 5 | $NbSi_2$ | 35 μm | Cristobalite $SiO_2$ | 5 μm | Alumina fiber | 6 μm | 100 μm | 5 | 52000 | 1% | 3% |

TABLE 3-continued

| | Conditions (raw materials) | | | | | | | | Results (performance) | | |
|---|---|---|---|---|---|---|---|---|---|---|---|
| | Cond. particles | | 1st inorg. material | | Fibrous 2nd inorg. material | | | | | Cycle durability % Resistivity change (%) Test Voltage | |
| | Material | Particle size (μm) | Material | Particle size (μm) | Material | Fiber diam. (μm) | Fiber length (μm) | Vol. fraction (%) | PTC effect (x) | 15 V | 24 V |
| Ex. 6 | $MoSi_2$ | 35 μm | Cristobalite $SiO_2$ | 5 μm | Alumina fiber | 6 μm | 200 μm | 5 | 41000 | 1% | 3% |
| Ex. 7 | $MoSi_2$ | 45 μm | Cristobalite $SiO_2$ | 5 μm | Alumina fiber | 6 μm | 200 μm | 5 | 154000 | 1% | 4% |
| Ex. 8 | $MoSi_2$ | 35 μm | Cristobalite $SiO_2$ | 5 μm | Alumina fiber | 6 μm | 1000 μm | 5 | 85000 | 1% | 3% |
| Ex. 9 | $MoSi_2$ | 45 μm | Cristobalite $SiO_2$ | 5 μm | Alumina fiber | 6 μm | 1000 μm | 5 | 132000 | 2% | 4% |
| Ex. 10 | $MoSi_2$ | 15 μm | Cristobalite $SiO_2$ | 5 μm | Alumina fiber | 6 μm | 100 μm | 5 | 1400 | 0% | 2% |
| Ex. 11 | $MoSi_2$ | 35 μm | Cristobalite $SiO_2$ | 5 μm | Alumina fiber | 9 μm | 100 μm | 29 | 3200 | 5% | 7% |
| Ex. 12 | $MoSi_2$ | 45 μm | Cristobalite $SiO_2$ | 5 μm | Alumina fiber | 9 μm | 100 μm | 29 | 6500 | 6% | 9% |
| Ex. 13 | $MoSi_2$ | 35 μm | Carnegieite ($NaAlSiO_4$) | 3 μm | Alumina fiber | 6 μm | 100 μm | 5 | 7000 | 1% | 5% |
| Ex. 14 | $MoSi_2$ | 35 μm | Carnegieite ($NaAlSiO_4$) | 5 μm | Alumina fiber | 6 μm | 100 μm | 5 | 9000 | 2% | 7% |
| Ex. 15 | $MoSi_2$ | 35 μm | Tridymite $SiO_2$ | 3 μm | Alumina fiber | 6 μm | 100 μm | 5 | 15000 | 3% | 6% |
| Ex. 16 | $MoSi_2$ | 35 μm | Tridymite $SiO_2$ | 5 μm | Alumina fiber | 6 μm | 100 μm | 5 | 25000 | 4% | 8% |
| Ex. 17 | $MoSi_2$ | 35 μm | Cristobalite $SiO_2$ | 5 μm | Alumina-silica fiber | 6 μm | 100 μm | 5 | 69000 | 2% | 6% |
| Ex. 18 | $TiSi_2$ | 35 μm | Cristobalite $SiO_2$ | 5 μm | Alumina fiber | 6 μm | 100 μm | 5 | 61000 | 3% | 7% |
| Ex. 19 | $TiB_2$ | 35 μm | Cristobalite $SiO_2$ | 5 μm | Alumina fiber | 6 μm | 100 μm | 5 | 31000 | 7% | 10% |
| Ex. 20 | $MoSi_2$ | 35 μm | Cristobalite $SiO_2$ | 10 μm | Alumina fiber | 6 μm | 100 μm | 5 | 62000 | 5% | 7% |
| Ex. 21 | $MoSi_2$ | 45 μm | Cristobalite $SiO_2$ | 10 μm | Alumina fiber | 6 μm | 100 μm | 5 | 334000 | 7% | 9% |
| Ex. 22 | $MoSi_2$ | 35 μm | Cristobalite $SiO_2$ | 5 μm | Alumina fiber | 6 μm | 80 μm | 5 | 76000 | 4% | 10% |
| Ex. 23 | $MoSi_2$ | 35 μm | Cristobalite $SiO_2$ | 5 μm | Tyrano fiber | 6 μm | 50 μm | 5 | 145000 | 6% | 10% |
| Ex. 24 | $MoSi_2$ | 35 μm | Cristobalite $SiO_2$ | 5 μm | Alumina fiber | 9 μm | 100 μm | 5 | 84000 | 6% | 8% |
| Comp. Ex.1 | $MoSi_2$ | 35 μm | Cristobalite $SiO_2$ | 5 μm | | None | | | 177000 | 25% | 120% |

4-3. Volume Fraction of Second Inorganic Material

Table 4 shows comparative data when the volume fraction of the fibrous second inorganic material in the matrix phase was varied. As shown in Table 4, in Examples 31 and 39, the volume fraction of the second inorganic material was 0.9%, which is sufficient for PTC effect. The cycle durability at 15 V was 10%, which is slightly lower than that of the case where the volume fraction was 5%; i.e., as compared with Examples 1, 2, 24, and 25. In Examples 31 and 39, the cycle durability values at 24 V were 15% and 55%, respectively. The PTC thermistor members of Examples 31 and 39 exhibited a cycle durability at high voltage, which is slightly lower than that of the case where the volume fraction was 5%; i.e., as compared with Examples 1, 2, 24, and 25. Thus, when the fibrous second inorganic material content is lower than 1%, the effect of the fibrous second inorganic material on suppressing progress of cracking in the matrix phase is insufficient. In other words, durability against repeated passage of current is not sufficiently high.

In contrast, the volume fraction of the second inorganic material in Example 32 was 31%, and the PTC effect was 900 times. In the case where such a PTC material is used as the PTC thermistor member 2, the use of the member is somewhat limited. That is, the member may be used for a case where a PTC effect of about 900 times is allowed. Thus, when the volume fraction of the second inorganic material is greater than 30%, the PTC effect is slightly low. Therefore, the volume fraction of the fibrous second inorganic material in the matrix phase is preferably 1% to 30%.

TABLE 4

| | Conditions (raw materials) | | | | | | | | Results (performance) | | |
|---|---|---|---|---|---|---|---|---|---|---|---|
| | Cond. particles | | 1st inorg. material | | 2nd inorg. material | | | | | Cycle durability % Resistivity change (%) Test Voltage | |
| | Material | Particle size (μm) | Material | Particle size (μm) | Material | Fiber diam. (μm) | Fiber length (μm) | Vol. fraction (%) | PTC effect (x) | 15 V | 24 V |
| Ex. 31 | $MoSi_2$ | 35 μm | Tridymite $SiO_2$ | 5 μm | Alumina fiber | 6 μm | 100 μm | 0.9 | 36000 | 10% | 15% |
| Ex. 39 | $MoSi_2$ | 35 μm | Cristobalite $SiO_2$ | 5 μm | Alumina fiber | 6 μm | 100 μm | 0.9 | 76000 | 10% | 55% |
| Ex. 1 | $MoSi_2$ | 35 μm | Cristobalite $SiO_2$ | 5 μm | Alumina fiber | 6 μm | 100 μm | 5 | 55000 | 1% | 4% |
| Ex. 2 | $MoSi_2$ | 45 μm | Cristobalite $SiO_2$ | 5 μm | Alumina fiber | 6 μm | 100 μm | 5 | 221000 | 2% | 5% |
| Ex. 24 | $MoSi_2$ | 35 μm | Cristobalite $SiO_2$ | 5 μm | Alumina fiber | 9 μm | 100 μm | 5 | 84000 | 6% | 8% |
| Ex. 25 | $MoSi_2$ | 45 μm | Cristobalite $SiO_2$ | 5 μm | Alumina fiber | 9 μm | 100 μm | 5 | 325000 | 7% | 12% |
| Ex. 11 | $MoSi_2$ | 35 μm | Cristobalite $SiO_2$ | 5 μm | Alumina fiber | 9 μm | 100 μm | 29 | 3200 | 5% | 7% |
| Ex. 12 | $MoSi_2$ | 45 μm | Cristobalite $SiO_2$ | 5 μm | Alumina fiber | 9 μm | 100 μm | 29 | 6500 | 6% | 9% |
| Ex. 32 | $MoSi_2$ | 35 μm | Cristobalite $SiO_2$ | 5 μm | Alumina fiber | 6 μm | 100 μm | 31 | 900 | 4% | 7% |
| Comp. Ex. 1 | $MoSi_2$ | 35 μm | Cristobalite $SiO_2$ | 5 μm | | None | | | 177000 | 25% | 120% |

4-4. Fiber Length of Second Inorganic Material

Table 5 shows comparative data when the fiber length of the fibrous second inorganic material was varied. As shown in Table 5, the PTC effect and cycle durability at 15 V were favorable, regardless of the fiber length.

In contrast, the percent change in electrical resistivity at 24 V showed a slightly different feature. When a second inorganic material having a fiber length of 100 μm or greater was used, the percent change in electrical resistivity at 24 V was 5% or lower. When the fiber length was 80 μm, the cycle durability at 24 V was about 10% to about 15%. When the fiber length was 50 μm, the cycle durability at 24 V was about 25% to about 45%. In other words, through use of a second inorganic material having a fiber length of 100 μm or greater, the cycle durability against high-voltage conditions can be enhanced. For example, it is preferred that a second inorganic material having a fiber length of 100 μm to 2,000 μm is used. Particularly, the fiber length is more preferably 100 μm to 1,000 μm.

TABLE 5

| | Conditions (raw materials) | | | | | | | | Results (performance) | | |
|---|---|---|---|---|---|---|---|---|---|---|---|
| | Cond. particles | | 1st inorg. material | | Fibrous 2nd inorg. material | | | | | Cycle durability % Resistivity change (%) Test Voltage | |
| | Material | Particle size (μm) | Material | Particle size (μm) | Material | Fiber diam. (μm) | Fiber length (μm) | Vol. fraction (%) | PTC effect (x) | 15 V | 24 V |
| Ex. 36 | $MoSi_2$ | 35 μm | Cristobalite $SiO_2$ | 5 μm | Alumina fiber | 6 μm | 50 μm | 5 | 86000 | 7% | 26% |
| Ex. 37 | $MoSi_2$ | 45 μm | Cristobalite $SiO_2$ | 6 μm | Alumina fiber | 6 μm | 50 μm | 5 | 332000 | 9% | 42% |
| Ex. 22 | $MoSi_2$ | 35 μm | Cristobalite $SiO_2$ | 5 μm | Alumina fiber | 6 μm | 80 μm | 5 | 76000 | 4% | 10% |
| Ex. 30 | $MoSi_2$ | 45 μm | Cristobalite $SiO_2$ | 5 μm | Alumina fiber | 6 μm | 80 μm | 5 | 232000 | 6% | 15% |
| Ex. 1 | $MoSi_2$ | 35 μm | Cristobalite $SiO_2$ | 5 μm | Alumina fiber | 6 μm | 100 μm | 5 | 55000 | 1% | 4% |
| Ex. 2 | $MoSi_2$ | 45 μm | Cristobalite $SiO_2$ | 5 μm | Alumina fiber | 6 μm | 100 μm | 5 | 221000 | 2% | 5% |
| Ex. 6 | $MoSi_2$ | 35 μm | Cristobalite $SiO_2$ | 5 μm | Alumina fiber | 6 μm | 200 μm | 5 | 41000 | 1% | 3% |
| Ex. 7 | $MoSi_2$ | 45 μm | Cristobalite $SiO_2$ | 5 μm | Alumina fiber | 6 μm | 200 μm | 5 | 154000 | 1% | 4% |

TABLE 5-continued

| | Conditions (raw materials) | | | | | | | | Results (performance) | | |
|---|---|---|---|---|---|---|---|---|---|---|---|
| | Cond. particles | | 1st inorg. material | | Fibrous 2nd inorg. material | | | | | Cycle durability % Resistivity change (%) Test Voltage | |
| | Material | Particle size (μm) | Material | Particle size (μm) | Material | Fiber diam. (μm) | Fiber length (μm) | Vol. fraction (%) | PTC effect (x) | 15 V | 24 V |
| Ex. 8 | $MoSi_2$ | 35 μm | Cristobalite $SiO_2$ | 5 μm | Alumina fiber | 6 μm | 1000 μm | 5 | 85000 | 1% | 3% |
| Ex. 9 | $MoSi_2$ | 45 μm | Cristobalite $SiO_2$ | 5 μm | Alumina fiber | 6 μm | 1000 μm | 5 | 132000 | 2% | 4% |
| Comp. Ex. 1 | $MoSi_2$ | 35 μm | Cristobalite $SiO_2$ | 5 μm | None | | | | 177000 | 25% | 120% |

4-5. Fiber Diameter of Second Inorganic Material

Table 6 shows comparative data when the fiber diameter of the fibrous second inorganic material phase was varied. As shown in Table 6, the PTC effect and cycle durability at 15 V were favorable, regardless of the fiber diameter.

In contrast, the percent change in electrical resistivity at 24 V showed a slightly different feature. When the fiber diameter of the second inorganic material was 11 μm, the percent change in electrical resistivity at 24 V was about 25%. Thus, the fiber diameter of the second inorganic material is preferably 1 μm to 10 μm, particularly preferably 3 μm to 8 μm.

TABLE 6

| | Conditions (raw materials) | | | | | | | | Results (performance) | | |
|---|---|---|---|---|---|---|---|---|---|---|---|
| | Cond. particles | | 1st inorg. material | | Fibrous 2nd inorg. material | | | | | Cycle durability % Resistivity change (%) Test Voltage | |
| | Material | Particle size (μm) | Material | Particle size (μm) | Material | Fiber diam. (μm) | Fiber length (μm) | Vol. fraction (%) | PTC effect (x) | 15 V | 24 V |
| Ex. 1 | $MoSi_2$ | 35 μm | Cristobalite $SiO_2$ | 5 μm | Alumina fiber | 6 μm | 100 μm | 5 | 55000 | 1% | 4% |
| Ex. 2 | $MoSi_2$ | 45 μm | Cristobalite $SiO_2$ | 5 μm | Alumina fiber | 6 μm | 100 μm | 5 | 221000 | 2% | 5% |
| Ex. 16 | $MoSi_2$ | 35 μm | Tridymite $SiO_2$ | 5 μm | Alumina fiber | 6 μm | 100 μm | 5 | 25000 | 4% | 8% |
| Ex. 24 | $MoSi_2$ | 35 μm | Cristobalite $SiO_2$ | 5 μm | Alumina fiber | 9 μm | 100 μm | 5 | 84000 | 6% | 8% |
| Ex. 25 | $MoSi_2$ | 45 μm | Cristobalite $SiO_2$ | 5 μm | Alumina fiber | 9 μm | 100 μm | 5 | 325000 | 7% | 12% |
| Ex. 35 | $MoSi_2$ | 35 μm | Cristobalite $SiO_2$ | 5 μm | Alumina fiber | 11 μm | 100 μm | 5 | 82000 | 10% | 25% |
| Ex. 40 | $MoSi_2$ | 35 μm | Tridymite $SiO_2$ | 5 μm | Alumina fiber | 11 μm | 100 μm | 5 | 22000 | 11% | 27% |
| Comp. Ex. 1 | $MoSi_2$ | 35 μm | Cristobalite $SiO_2$ | 5 μm | None | | | | 177000 | 25% | 120% |

4-6. Material and Particle Size of First Inorganic Material

Table 7 shows comparative data when the material and the particle size of the first inorganic material were varied. As shown in Table 7, under any conditions of the material and the particle size of the first inorganic material, a favorable PTC effect was attained. When the mean particle size of the first inorganic material was 55 μm, the percent change in electrical resistivity at 15 V was about 10% to about 20%, and the percent change in electrical resistivity at 24 V was about 45% to about 75%. Conceivably, when the mean particle size is great, relatively great stress tends to generate around the first inorganic material.

When the mean particle size of the first inorganic material was 50 μm or less, the percent change in electrical resistivity at 15 V was 10% or lower, and the percent change in electrical resistivity at 24 V was about 35% or lower. Thus, the mean particle of the first inorganic material is preferably 1 μm to 50 μm. When the mean particle size of the first inorganic material is 1 μm to 30 μm, the percent change in electrical resistivity was suppressed to 10% or lower at a test voltage of 15 V and 24 V. In other words, the mean particle size of the first inorganic material is more preferably 1 μm to 30 μm. The mean particle size of the first inorganic material may fall within the range of 1 μm to 10 μm.

TABLE 7

| | Conditions (raw materials) | | | | | | | | Results (performance) | | |
|---|---|---|---|---|---|---|---|---|---|---|---|
| | Cond. particles | | 1st inorg. material | | Fibrous 2nd inorg. material | | | | | Cycle durability % Resistivity change (%) Test Voltage | |
| | Material | Particle size (μm) | Material | Particle size (μm) | Material | Fiber diam. (μm) | Fiber length (μm) | Vol. fraction (%) | PTC effect (x) | 15 V | 24 V |
| Ex. 13 | $MoSi_2$ | 35 μm | Carnegieite ($NaAlSiO_4$) | 3 μm | Alumina fiber | 6 μm | 100 μm | 5 | 7000 | 1% | 5% |
| Ex. 15 | $MoSi_2$ | 35 μm | Tridymite $SiO_2$ | 3 μm | Alumina fiber | 6 μm | 100 μm | 5 | 15000 | 3% | 6% |
| Ex. 1 | $MoSi_2$ | 35 μm | Cristobalite $SiO_2$ | 5 μm | Alumina fiber | 6 μm | 100 μm | 5 | 55000 | 1% | 4% |
| Ex. 2 | $MoSi_2$ | 45 μm | Cristobalite $SiO_2$ | 5 μm | Alumina fiber | 6 μm | 100 μm | 5 | 221000 | 2% | 5% |
| Ex. 20 | $MoSi_2$ | 35 μm | Cristobalite $SiO_2$ | 10 μm | Alumina fiber | 6 μm | 100 μm | 5 | 62000 | 5% | 7% |
| Ex. 21 | $MoSi_2$ | 45 μm | Cristobalite $SiO_2$ | 10 μm | Alumina fiber | 6 μm | 100 μm | 5 | 334000 | 7% | 9% |
| Ex. 34 | $MoSi_2$ | 35 μm | Cristobalite $SiO_2$ | 45 μm | Alumina fiber | 6 μm | 100 μm | 5 | 76000 | 8% | 21% |
| Ex. 38 | $MoSi_2$ | 45 μm | Cristobalite $SiO_2$ | 45 μm | Alumina fiber | 6 μm | 100 μm | 5 | 352000 | 10% | 35% |
| Ex. 41 | $MoSi_2$ | 35 μm | Cristobalite $SiO_2$ | 55 μm | Alumina fiber | 6 μm | 100 μm | 5 | 108000 | 12% | 46% |
| Ex. 42 | $MoSi_2$ | 45 μm | Cristobalite $SiO_2$ | 55 μm | Alumina fiber | 6 μm | 100 μm | 5 | 692000 | 19% | 72% |
| Comp. Ex. 1 | $MoSi_2$ | 35 μm | Cristobalite $SiO_2$ | 5 μm | | None | | | 177000 | 25% | 120% |

4-7. Material of Conductive Particles

Table 8 shows comparative data when the material and the particle size of the conductive particles were varied. As shown in Table 8, the PTC effect and cycle durability at a test voltage of 15 V were favorable, although the conductive particles were made of any material. Specifically, when the test voltage was 15 V, the change in electrical resistivity was 10% or less.

In the case where the test voltage was 24 V, when the conductive particles were made of $MoSi_2$, $TiSi_2$, or $NbSi_2$, the change in electrical resistivity was 10% or less. When the conductive particles were made of $TiB_2$, TiC, TiN, Ni, or Mo, the change in electrical resistivity was 10% to 20%. Thus, when a metal silicide was used as the material of the conductive particles, a high-cycle durability was attained at high voltage. Therefore, when the first inorganic material made of a silicon-containing material is used, conductive particles made of metal silicide is preferably used.

TABLE 8

| | Conditions (raw materials) | | | | | | | | Results (performance) | | |
|---|---|---|---|---|---|---|---|---|---|---|---|
| | Cond. particles | | 1st inorg. material | | Fibrous 2nd inorg. material | | | | | Cycle durability % Resistivity change (%) Test Voltage | |
| | Material | Particle size (μm) | Material | Particle size (μm) | Material | Fiber diam. (μm) | Fiber length (μm) | Vol. fraction (%) | PTC effect (x) | 15 V | 24 V |
| Ex. 1 | $MoSi_2$ | 35 μm | Cristobalite $SiO_2$ | 5 μm | Alumina fiber | 6 μm | 100 μm | 5 | 55000 | 1% | 4% |
| Ex. 2 | $MoSi_2$ | 45 μm | Cristobalite $SiO_2$ | 5 μm | Alumina fiber | 6 μm | 100 μm | 5 | 221000 | 2% | 5% |
| Ex. 5 | $NbSi_2$ | 35 μm | Cristobalite $SiO_2$ | 5 μm | Alumina fiber | 6 μm | 100 μm | 5 | 52000 | 1% | 3% |
| Ex. 18 | $TiSi_2$ | 35 μm | Cristobalite $SiO_2$ | 5 μm | Alumina fiber | 6 μm | 100 μm | 5 | 61000 | 3% | 7% |
| Ex. 19 | $TiB_2$ | 35 μm | Cristobalite $SiO_2$ | 5 μm | Alumina fiber | 6 μm | 100 μm | 5 | 31000 | 7% | 10% |
| Ex. 26 | TiC | 35 μm | Cristobalite $SiO_2$ | 5 μm | Alumina fiber | 6 μm | 100 μm | 5 | 65000 | 6% | 11% |
| Ex. 27 | TiN | 35 μm | Cristobalite $SiO_2$ | 5 μm | Alumina fiber | 6 μm | 100 μm | 5 | 42000 | 8% | 15% |

TABLE 8-continued

| | Conditions (raw materials) | | | | | | | | Results (performance) | | |
|---|---|---|---|---|---|---|---|---|---|---|---|
| | Cond. particles | | 1st inorg. material | | Fibrous 2nd inorg. material | | | | | Cycle durability % Resistivity change (%) Test Voltage | |
| | Material | Particle size (μm) | Material | Particle size (μm) | Material | Fiber diam. (μm) | Fiber length (μm) | Vol. fraction (%) | PTC effect (x) | 15 V | 24 V |
| Ex. 28 | Ni | 35 μm | Cristobalite $SiO_2$ | 5 μm | Alumina fiber | 6 μm | 100 μm | 5 | 39000 | 6% | 18% |
| Ex. 29 | Mo | 35 μm | Cristobalite $SiO_2$ | 5 μm | Alumina fiber | 6 μm | 100 μm | 5 | 85000 | 8% | 12% |
| Comp. Ex. 1 | $MoSi_2$ | 35 μm | Cristobalite $SiO_2$ | 5 μm | | None | | | 177000 | 25% | 120% |

In Experiment 1, no description was given for cristobalite-form aluminum phosphate and tridymite-form aluminum phosphate. However, as shown in Table 1, these two materials undergo phase transition in crystal structure type at a corresponding phase transition temperature. Therefore, the materials may also be used as the first inorganic material.

4-8. Long-Term Durability

Long-term durability of the tested PTC members exhibited almost the same tendency as that of cycle durability. Thus, description of the features regarding the long-term durability is omitted in the Tables.

(B) Experiment 2

Next will be described Experiment 2. Experiment 2 corresponds to the second embodiment. In Experiment 2, the third inorganic material was used. Differing from Experiment 1, a high-softening-point S glass fiber was used as the second inorganic material.

1. Raw Materials

Cristobalite-form silicon dioxide (mean particle size: 5 μm) was used as the first inorganic material. As the second inorganic material, a high-softening-point S glass fiber was used. The high-softening-point S glass fiber had a mean fiber diameter of 10 μm and a mean fiber length of 100 μm. The volume fraction of the high-softening-point S glass fiber in the matrix phase was adjusted to 5%. Conductive particles having a mean particle size of 35 μm were used. The volume fraction of the conductive particles in the matrix phase was adjusted to 23%.

2. Results of Experiment

Table 9 shows comparative data when the material of the third inorganic material was varied. As shown in Examples 43 to 52 in Table 9, when a glass fiber having a softening point of 800° C. or lower is used as the third inorganic material, firing can be performed at 900° C. or lower in a hydrogen atmosphere. Thus, a metal or alloy having a melting point or temperature of 900° C. or higher can be baked to form an electrode during the firing step. Examples of the metal or alloy having a melting point or temperature of 900° C. or higher include pure copper, high-copper alloys (beryllium-copper, titanium-copper, zirconium-copper, tin-containing copper, and iron-containing copper), bronze, nickel silver, phosphor bronze, and copper-nickel alloy. Since the exemplified metals and alloys melt at about 1,100° C., these metallic materials cannot be baked through simultaneous firing. Also, when a glass having a softening point of 600° C. or lower is used, firing can be performed at 800° C. or lower in a hydrogen atmosphere. In some cases, the firing temperature may be 700° C. or lower. The same results can be attained when a non-oxidizing firing atmosphere such as nitrogen or argon, other than hydrogen is employed.

TABLE 9

| | Cond. particles Particle size: 35 μm | 3rd inorg. material Glass material | Softening point | Firing conditions H atmosphere | Specific resistance Room temp. |
|---|---|---|---|---|---|
| Ex. 43 | TiC | Pb borate glass | 445° C. | 545° C. | 0.06 Ωcm |
| Ex. 44 | TiC | Pb borosilicate glass | 505° C. | 605° C. | 0.08 Ωcm |
| Ex. 45 | TiC | Pb silicate glass | 555° C. | 655° C. | 0.09 Ωcm |
| Ex. 46 | TiC | Borosilicate glass | 680° C. | 780° C. | 0.09 Ωcm |
| Ex. 47 | TiC | Bi borate glass | 320° C. | 420° C. | 0.12 Ωcm |
| Ex. 48 | TiC | Phosphate glass | 310° C. | 410° C. | 0.14 Ωcm |
| Ex. 49 | TiC | Vanadate glass | 270° C. | 370° C. | 0.09 Ωcm |
| Ex. 50 | $FeSi_2$ | Pb borosilicate glass | 505° C. | 605° C. | 0.32 Ωcm |
| Ex. 51 | Ni | Pb borosilicate glass | 505° C. | 605° C. | 0.02 Ωcm |
| Ex. 52 | SUS304 | Pb borosilicate glass | 505° C. | 605° C. | 0.04 Ωcm |
| Ex. 53 | TiC | $SiO_2$—RO—ZnO glass | 810° C. | 910° C. | 0.12 Ωcm |
| Ex. 54 | SUS304 | $SiO_2$—$B_2O_3$—$Na_2O$—CaO glass | 880° C. | 980° C. | 0.35 Ωcm |
| Ex. 55 | Hastelloy | $SiO_2$—$B_2O_3$—CaO—$K_2O$ glass | 930° C. | 930° C. | 0.39 Ωcm |
| Ex. 56 | $FeSi_2$ | RO—$SiO_2$—ZnO glass | 810° C. | 910° C. | 0.37 Ωcm |
| Ex. 57 | SUS304 | None | — | 1450° C. | |

It should not be understood that the scope of the present invention is limited to the type and combination of the materials, particle size, and production method of the first inorganic material, the second inorganic material, and the conductive particles, which are described in the aforementioned Examples.

INDUSTRIAL APPLICABILITY

The present invention is suitably applied to an over current suppression device to be installed in an electric apparatus for mobile use, a domestic electric appliance, an information apparatus, etc. Also, the present invention can be suitably applied to a PTC heater device.

DESCRIPTION OF THE REFERENCE NUMERALS

1 PTC thermistor device
2 PTC thermistor member
3*a*, 3*b* electrode

The invention claimed is:

1. A positive temperature coefficient of resistance (PTC) thermistor member, comprising:
a matrix phase; and
conductive particles dispersed throughout the matrix phase,
wherein the matrix phase comprises an electrically insulating first inorganic material and an electrically insulating second inorganic material,
wherein the first inorganic material undergoes phase transition in terms of crystal structure type and change in volume, at a phase transition temperature thereof,
wherein the first inorganic material comprises at least one material selected from among cristobalite-form silicon dioxide, tridymite-form silicon dioxide, cristobalite-form aluminum phosphate, tridymite-form aluminum phosphate, and carnegiette,
wherein the second inorganic material is fibrous, and
wherein the second inorganic material has a fiber length of 50 μm to 1000 μm.

2. The PTC thermistor member according to claim 1, wherein the second inorganic material comprises at least one material selected from among zirconia fiber, alumina fiber, silica fiber, alumina-silica fiber, insulating tyranno fiber, and glass fiber.

3. The PTC thermistor member according to claim 2, wherein the matrix phase comprises an electrically insulating third inorganic material, and
wherein the third inorganic material includes a glass composition having a softening point of 800° C. or lower.

4. The PTC thermistor member according to claim 2, wherein the PTC thermistor member has an electrical resistivity at a temperature equal to or higher than the phase transition temperature, which resistivity is at least 1,000 times greater than that at room temperature.

5. The PTC thermistor member according to claim 1, wherein the matrix phase comprises an electrically insulating third inorganic material, and
wherein the third inorganic material includes a glass composition having a softening point of 800° C. or lower.

6. The PTC thermistor member according to claim 5, wherein the glass composition comprises at least one material selected from among borosilicate glass, bismuth borosilicate glass, lead borate glass, lead silicate glass, lead borosilicate glass, phosphate glass, and vanadate glass.

7. The PTC thermistor member according to claim 1, wherein the second inorganic material has a mean fiber diameter of 1 μm to 10 μm.

8. The PTC thermistor member according to claim 1, wherein a volume fraction of the second inorganic material with respect to the matrix phase is 5% to 30%.

9. The PTC thermistor member according to claim 1, wherein the first inorganic material is granular, and
wherein the first inorganic material has a mean particle size of 1 μm to 50 μm.

10. The PTC thermistor member according to claim 1, wherein the PTC thermistor member has an electrical resistivity at a temperature equal to or higher than the phase transition temperature, which resistivity is at least 1,000 times greater than that at room temperature.

11. A positive temperature coefficient of resistance (PTC) thermistor member, comprising:
a matrix phase; and
conductive particles dispersed throughout the matrix phase,
wherein the matrix phase comprises an electrically insulating first inorganic material and an electrically insulating second inorganic material,
wherein the first inorganic material undergoes phase transition in terms of crystal structure type and change in volume, at a phase transition temperature thereof,
wherein the first inorganic material comprises at least one material selected from among cristobalite-form silicon dioxide, tridymite-form silicon dioxide, cristobalite-form aluminum phosphate, tridymite-form aluminum phosphate, and carnegieite,
wherein the second inorganic material is fibrous, and
wherein the second inorganic material has a mean fiber diameter of 1 μm to 10 μm.

12. The PTC thermistor member according to claim 11, wherein the second inorganic material comprises at least one material selected from among zirconia fiber, alumina fiber, silica fiber, alumina-silica fiber, insulating tyranno fiber, and glass fiber.

13. The PTC thermistor member according to claim 12, wherein the matrix phase comprises an electrically insulating third inorganic material, and
wherein the third inorganic material includes a glass composition having a softening point of 800° C. or lower.

14. The PTC thermistor member according to claim 12, wherein the PTC thermistor member has an electrical resistivity at a temperature equal to or higher than the phase transition temperature, which resistivity is at least 1,000 times greater than that at room temperature.

15. The PTC thermistor member according to claim 11, wherein the matrix phase comprises an electrically insulating third inorganic material, and
wherein the third inorganic material includes a glass composition having a softening point of 800° C. or lower.

16. The PTC thermistor member according to claim 15, wherein the glass composition comprises at least one material selected from among borosilicate glass, bismuth borosilicate glass, lead borate glass, lead silicate glass, lead borosilicate glass, phosphate glass, and vanadate glass.

17. The PTC thermistor member according to claim 11, wherein the second inorganic material has a fiber length of 50 μm to 1000 μm.

18. The PTC thermistor member according to claim 11, wherein a volume fraction of the second inorganic material with respect to the matrix phase is 5% to 30%.

19. The PTC thermistor member according to claim 11, wherein the first inorganic material is granular, and wherein the first inorganic material has a mean particle size of 1 μm to 50 μm.

20. The PTC thermistor member according to claim 11, wherein the PTC thermistor member has an electrical resistivity at a temperature equal to or higher than the phase transition temperature, which resistivity is at least 1,000 times greater than that at room temperature.

* * * * *